United States Patent [19]

Houghton et al.

[11] 4,412,627

[45] Nov. 1, 1983

[54] DRAWN AND IRONED CAN BODY

[75] Inventors: Timothy J. Houghton; Carl J. Szwargulski, Jr.; Jerry A. Bentrup, all of St. Louis County; Donald L. Smidt, Jefferson County, all of Mo.

[73] Assignee: Metal Container Corporation, St. Louis, Mo.

[21] Appl. No.: 268,321

[22] Filed: May 29, 1981

[51] Int. Cl.[3] ..... B65D 6/02; B65D 7/42

[52] U.S. Cl. ..... 220/66; 220/70; 220/1 BC

[58] Field of Search ..... 220/66, 67, 70, 1 BC

[56] References Cited

U.S. PATENT DOCUMENTS

| | | | |
|---|---|---|---|
| 3,904,069 | 9/1975 | Toukmanian | 220/66 |
| 3,979,009 | 9/1976 | Walker | 220/66 |
| 4,120,419 | 10/1978 | Saunders | 220/66 |
| 4,177,746 | 12/1979 | Lee, Jr. et al. | 220/66 X |
| 4,231,483 | 11/1980 | Dechenne et al. | 220/66 |
| 4,294,373 | 10/1981 | Miller et al. | 220/70 |

*Primary Examiner*—William Price
*Assistant Examiner*—David Voorhees
*Attorney, Agent, or Firm*—Gravely, Lieder & Woodruff

[57] ABSTRACT

A drawn and ironed can body has a cylindrical side wall and an integral end wall which closes one end of the side wall. The end wall includes a rim that generally curves inwardly from the side wall and a domed central section which closes the area circumscribed by the rim, all such that the rim forms the lowest portion of the can body. The rim is configured such that when the can body is subjected to elevated internal pressures, the rim deforms in a controlled manner, and this deformation causes the domed wall to move axially away from the opposite end of the can body without buckling, thereby increasing the volume of the can body.

22 Claims, 5 Drawing Figures

(EMPTY CAN)

(MODERATE PRESSURE)

(HIGH PRESSURE)

DRAWN AND IRONED CAN BODY

BACKGROUND OF THE INVENTION

This invention relates in general to a drawn and ironed can, and more particularly to a drawn and ironed can body having an improved end wall configuration.

The so-called drawn and ironed can has to a large measure replaced the old three piece can, at least in the beverage industry. Moreover, these cans are made almost exclusively from aluminum, which being quite ductile, is easily drawn into a cylindrical configuration and ironed down to a very thin wall thickness. While the economies mass production are reflected in the low cost of the cans, the cost of the sheet aluminum from which the cans are manufactured has nevertheless always been an important consideration. Through the years various advances in can technology have enabled the can bodies to be manufactured from thinner and thinner aluminum sheet.

The typical drawn and ironed can consists of two components, namely a top and a can body. Only the latter is formed by a drawing and ironing procedure, and when completed it includes a very thin side wall and a domed end wall formed integral with the side wall at one end of the side wall. The opposite end of the side wall is joined to the top along a seam, but only after a beverage is introduced into the can body.

To form the can bodies, circular disks are first stamped from aluminum sheet stock of the appropriate thickness. This, of course, results in a considerable amount of scrap. Next, each disk is drawn into a cup. The cup is then placed over the end of a punch and forced through a die set where it is redrawn into a lesser diameter and ironed along its side wall to substantially reduce the thickness of the side wall while at the same time elongating the side wall. The end wall, however, retains the original thickness of the sheet stock, and after the side wall is completely ironed, the punch drives the end wall against an end forming die to impart a domed configuration and surrounding rim to it. This configuration enables the end wall to withstand high internal pressures without buckling outwardly and rendering the can unstable, and further gives it adequate column strength.

However, the use of thinner stock reduces the strength of the domed end wall, and even a slight reduction in thickness will cause a can having the conventional end wall profile to buckle outwardly under elevated pressures, such as the pressures that may be encountered during the pasteurization of beer. In other words, the external surface of the end wall changes from a concave configuration to a convex configuration, and when this occurs the can will not rest in a stable upright position on a horizontal surface. This may cause the can to topple during subsequent handling in the brewery and thereby disrupt equipment, and furthermore a buckled end wall destroys the appearance of the product. Moreover, cans with conventional end wall profiles have very little capacity for accommodating overfill without buckling the end wall.

SUMMARY OF THE INVENTION

One of the principal objects of the present invention is to provide a drawn and ironed beverage can that may be manufactured from extremely thin sheet metal stock. Another object is to provide a can of the type stated that will withstand extremely high internal pressures without deforming to the extent that the can is unstable or appears defective. A further object is to provide a can of the type stated that has an exceedingly high overfill capacity. An additional object is to provide a can of the type stated that has high column strength. Still another object is to provide a can of the type stated that is attractive in appearance. Yet another object is to provide a can of the type stated that undergoes a controlled deformation in its rim to accommodate elevated pressures. Still another object is to provide a can of the type stated that is capable of passing through conventional can handling equipment without significant changes or adjustment to that equipment. These and other objects and advantages will become apparent hereinafter.

The present invention is embodied in a can body that has a cylindrical side wall and an end wall at one end of the side wall. The end wall has an annular rim and a domed central section. The rim is capable of yielding before the central section undergoes a substantial deformation, and the yielding is such that the domed wall moves axially and increases the volume of the can body. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
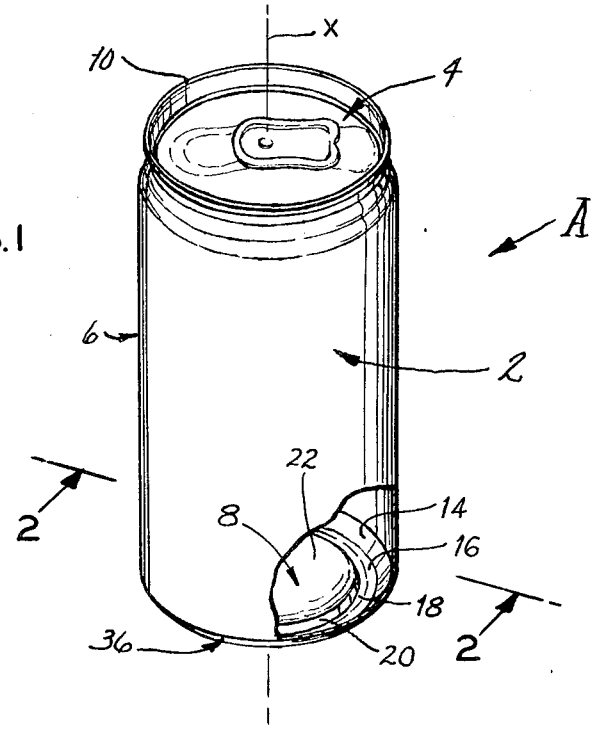
FIG. 1 is a perspective view of a beverage can having a drawn and ironed can body constructed in accordance with and embodying the present invention.

Referring now to the drawings, a beverage can A (FIG. 1) consists of two components, namely a can body 2 and an end or top wall 4. The can body 2 has a very thin side wall 6 and a somewhat thicker end wall 8 which are joined integrally to each other at one end of the side wall 6. The top wall 4 is fastened to the other end of the side wall 6 of the can body 2 at a chime 10, and when so fastened, the body 2 and end wall 4 enclose a fluid-tight cylindrical space in which a beverage or other liquid is contained. The top wall 4 is conventional and is joined to the can body 2 in a conventional seaming operation. The can A has a vertical axis x which is actually the center axis of the cylindrical side wall 6.

The can body 2 is formed in a drawing and ironing process which may be one of the typical drawing and ironing procedures used in the can industry. Basically, a disk is blanked from suitable sheet metal stock, which is usually aluminum. The disk is then drawn into a cup in a separate stamping operation, but this operation does not alter the thickness of the metal within the cup. In other words, the flat end wall and cylindrical side wall of the cup have the same thickness as the sheet metal stock. Next, the cup is placed on the end of a punch and by means of the punch is driven through a succession of dies. The first die is a redraw die which merely reduces the diameter of the cup side wall, but does not alter its thickness. The remaining dies are ironing dies which reduce the thickness of the cup side wall and further elongate it. Indeed, upon emerging from the last ironing die, the cup side wall is fully converted into the can body side wall 6 which is cylindrical in shape, having a radius a and a thickness b (FIG. 2), the latter being considerably less than the thickness of the original sheet metal stock.

Figure 2:
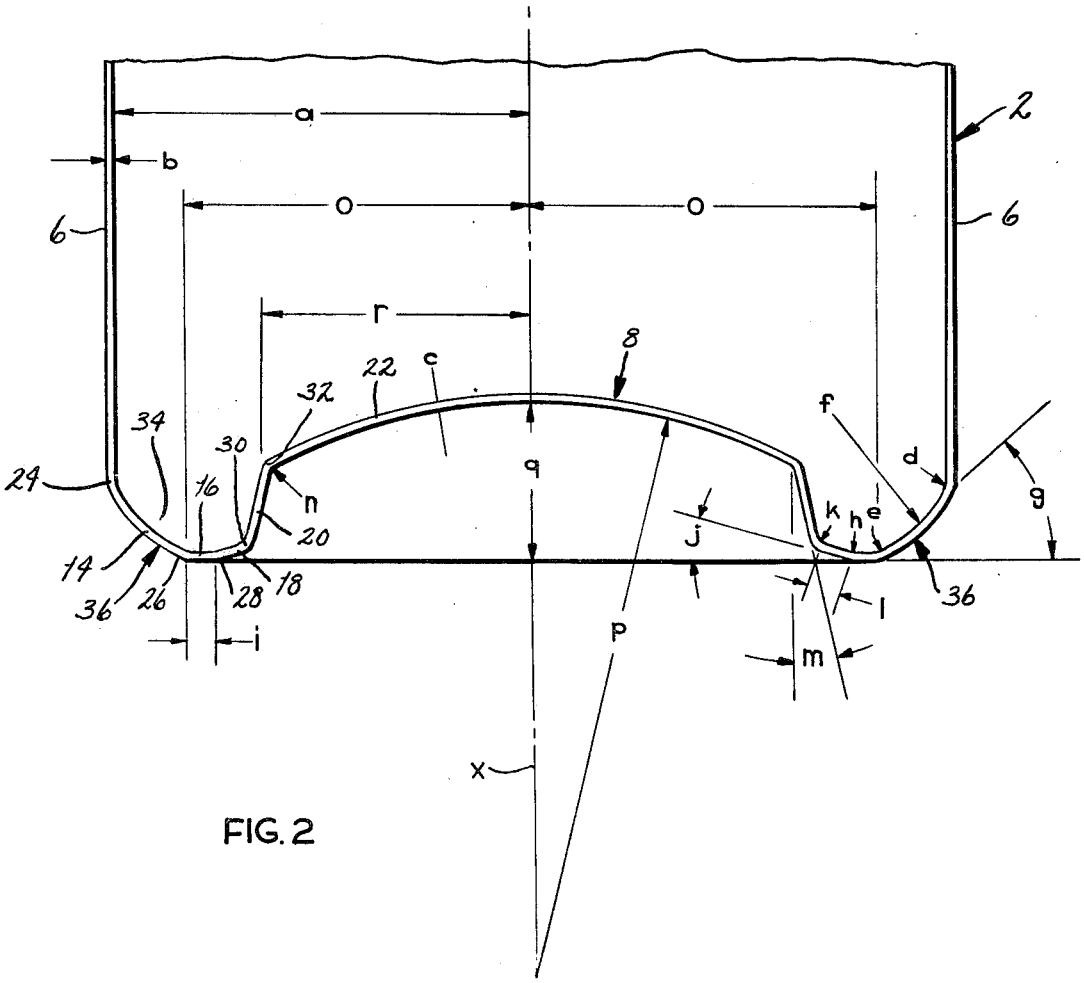
FIG. 2 is a partial sectional view of the can body taken along line 2—2 of FIG. 1 and showing the profile of the end wall.
Figure 3:
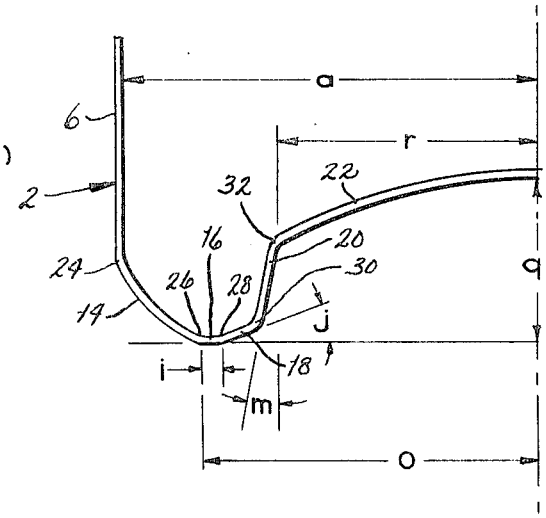
FIG. 3 is a fragmentary sectional view of the end wall as it is derived from the drawing and ironing operation.

As the free end of the side wall 8 passes out of the last ironing die, the flat end wall, which is at the opposite end of the completed side wall 6, encounters a forming die which converts that flat end wall into the contoured end wall 8 having the desired profile or configuration (FIG. 2). Actually the forward end of the punch and the forming die have complementary surfaces which cooperate to impart the desired configuration or profile to the end wall 8, this being done without altering the thickness c of the end wall 8. Indeed, that thickness remains the same as the thickness of the original sheet metal stock. It is the end wall 8, or more specifically the profile of the end wall 8, that constitutes the essence of this invention.

Beginning at the side wall 6 and going inwardly toward the can axis x, the end wall 8 includes a curved peripheral section 14, a flat base section 16, slightly inclined connecting section 18, a tapered intermediate section 20, and a domed central section 22. All of the sections 14, 16, 18, 20 and 22 are concentric about the axis x and all are essentially the same thickness which is the thickness of the sheet metal stock from which the can body 2 is derived. While the section 22 is disk-shaped, the remaining sections 14, 16, 18 and 20 are annular is shape.

The peripheral section 14 merges into the side wall 6 at a region 24 having a slight radius d, which is preceded by a much larger radius on the order of 4.5 in., the latter being so large that the area it occupies is considered merely part of the side wall 6. From the region 24 the peripheral section 14 turns downwardly and inwardly toward the axis x, and merges into the flat base section 16 at a barely distinguishable margin 26 having another slight radius e. Moreover, the peripheral section 14 has a radius f of curvature that is somewhat less than the radius of curvature on the end rims of conventional can bodies. Indeed the radius of curvature f may range from 0.400 in. to 0.600 in., and should be about 0.500 in. While the radius of curvature f for the peripheral section 14 is less than that on the rims of conventional can bodies, the extent of the arc described by the peripheral section 14 is considerably greater. In this regard, a line extended through the region 24 and the margin 26 and intersecting the axis x forms an included angle g with the horizontal, that is with a plane that is perpendicular to the axis x, and in contrast to conventional can bodies, that angle may be less than 45°. Indeed, it may range between 35° and 55° and should preferably be about 41°.

The flat section 16 lies in a plane that is perpendicular to the axis x. Along its outer margin 26 it merges into the curved peripheral section 14, and along its inner margin 28 it merges into the slightly inclined section 18 at another radius h. The inner margin 28 is likewise barely discernible. The width i of the flat section 16, which is the distance between the two circular margins 26 and 28, should range between 3% and 6% of the radius a for the can body 2 and should preferably be about 4.77%.

The inclined section 18 merges with the flat section 16 at the margin 28 and through the flat section 16 is connected to the peripheral section 14. The inclined section 18 is essentially conical in configuration in that it constitutes the frustum of a very shallow cone. Indeed, the included angle j between the section 18 and the horizontal, that is between the section 18 and a plane perpendicular to the axis x, may range between 10° and 20°, and should preferably be about 15°. In a sense the inclined section 18 is flat, not only because it forms the frustum of a very shallow cone, but also because in a vertical section of the can body 2, that is a section lying in a plane in which the center axis x lies, the inclined section 18 is straight. The inclined section 18 merges into the tapered section 20 at a corner 30 having a small radius k. The distance between the margin 28 and the corner 30 is of course the width 1 of the inclined section 18, and the width 1 should be between 3% and 7% of the radius a of the wall 6, and should preferably be 4.92%.

The tapered section 20 is disposed at a relatively small angle with respect to the axis x and it projects from the inclined section 18 generally upwardly. Indeed, the angle m between the tapered section 20 and the axis x should be between 2° and 5°, and should preferably be 2°41'. In short, the tapered section 20 is oriented in a generally upright disposition. The tapered section 20 at its lower end merges into the inclined section 18 at the corner 30 and at its upper end merges into the domed central section 22 along a bend 32 having a radius n. In this regard, the corner 30 is below the region 24 at which the side wall 6 merges into the end wall 8, while the bend 32 is above the region 24.

The tapered section 20 together with the inclined section 18 form a connecting region between the flat base section 16 and the domed central section 22.

The peripheral section 14, the flat section 16, the inclined section 18, and the tapered section 20 in combination create within the can body 2 an annular groove 34 that opens upwardly into the interior of the can body 2. On the external surface of the can body 2 they create circular rim 36 having an effective radius o that is 75% to 90% of the radius a of the side wall 6, and is preferably 81.5%, the radius o being measured at the outer margin 26 of the flat section 16, for that is the radius of the greatest area of support for the can A when it is placed upright on a horizontal supporting surface. The area encircled by the groove 34 is closed by the domed central section 22 which merges into the tapered section 20 at the bend 32.

The domed central section 22 has a radius p of curvature that is 130% to 140% of the radius a for the side wall 6, and is preferably 134.6%. Moreover, the depth q of the domed central section 22, which is the distance from the central section 22 to the plane of the flat section 16 measured along the axis x, should be between 25% and 35% of the radius a of the side wall 6, and preferably is about 29%. In addition, the central section 22 has a radius r which is the distance from the axis x to the bend 32 at the periphery of the section 22. The radius r is between 60% and 75% of the radius a of the side wall 6 and is preferably about 68.5%. The dome radius r, however, is smaller than the dome radii of conventional can bodies due to the greater arc of the peripheral section 14 and the presence of the flat section 16 and inclined section 18 which are in effect directed inwardly from the peripheral section 14.

The can body 2 is filled with a beverage or other liquid before the top wall 4 is applied. However, the equipment which meters the beverage may not be totally precise, and the possibility exists that a slight overfill may occur. Overfill or not, the top wall 4 is installed immediately after the beverage is metered into the can body 2, and in the accompanying seaming operation a fluid-tight joint is created along the chime 10. If the beverage is beer, the can A next passes through pasteurization equipment where the can A and the beverage within it are heated to about 140° F. The increase in temperature causes the gas in the head space of the can A to increase in pressure. As a result, the can experiences a substantial increase in internal pressure, and that pressure may reach as high as 90 lbs/in$^2$ gage. The bottom wall 8 of the can body 2 accommodates this increase in pressure, and though it may deform, it does not deform in a manner which impedes the movement of the can through handling equipment or renders the can A so unstable that it cannot rest upright on a horizontal surface.

Figure 4:
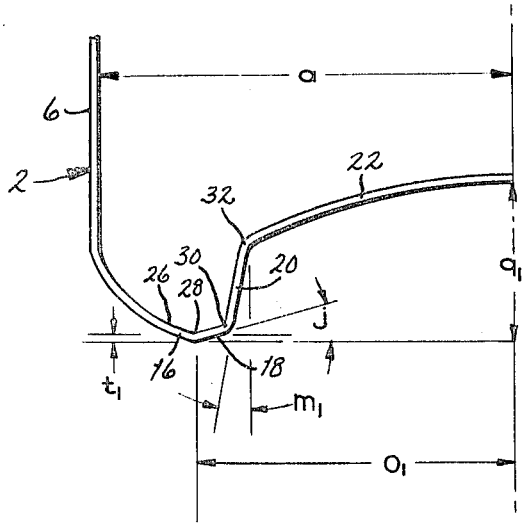
FIG. 4 is a fragmentary sectional view of the end wall after it has been subjected to moderate pressure.

Under normal pasteurization, the pressure which develops within the can A exerts a downwardly directed force on the domed section 22 of the end wall 8, and this force creates a moment which tends to bend or deform the can along the outer margin 26 of its flat base section 16. Indeed, the flat section 16 turns downwardly along the margin 26 and forms almost an indistinguishable continuation of the curved peripheral section 14 (FIG. 4). A further deformation occurs along the inner margin 28 of the flat section 16, but the angles j and m of the inclined section 18 and tapered section 20, respectively, remain about the same. The inner margin 28 of the section 16 now becomes the lowest point on the can body 2, so the rim radius $o_1$ is now taken from the margin 28. It is slightly less than the rim radius o of the unfilled can body 2. The deformation of the rim 36 at the margins 26 and 28 within it is of a permanent nature and increases the height of the can A slightly, but the increase $t_1$ is almost imperceptible and certainly does not in any way interfere with the passage of the can A through production equipment. More importantly, the domed central section 22 drops downwardly so that the space between the top wall 4 and the domed section 22 increases. This, of course, increases the volume of the can A and thereby, to a measure, relieves the pressure within the can A. In effect, the deformation provides greater head space above the liquid in the can A.

While the deformations at the margins 26 and 28 are perhaps the most pronounced, other deformations of a less significant character occur. For example, the radius f of the peripheral section 14 increases about 12% as does the radius n of the bend 32. The radius k of the corner 30 remains about the same. The depth $q_1$ of the domed central section 22 is slightly less than the depth q of the unfilled can body 2 as a result of a slight increase in the radius of curvature p. The rim radius o, however, decreases, but not enough to significantly affect the stability of the can A. Indeed, the can A exhibits no greater tendency to topple during handling than the unfilled can body 2. All of these deformations are of a permanent nature.

Figure 5:
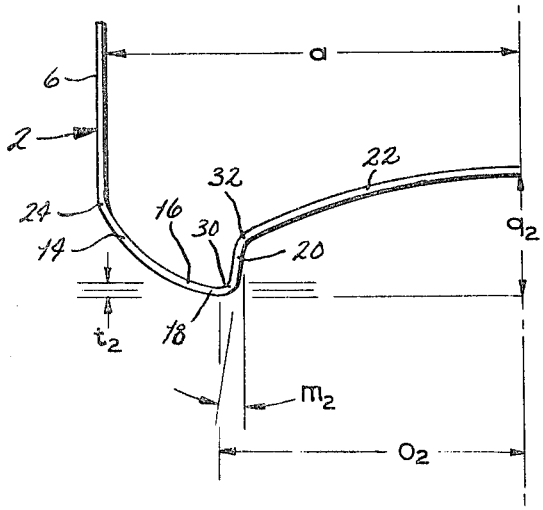
FIG. 5 is a fragmentary sectional view of the end wall after it has been subjected to relatively high pressure.

Should the can A with beer in it undergo severe pasteurization, such as may occur if it remains in the pasteurizer for as long as 30 min. at 180° F., the rim 36 of the end wall 8 for the can body 2 may deform still further to accommodate the even greater pressures that develop (FIG. 5). Of course, under these circumstances, the end wall 8 initially deforms at the outer margin 26 of its flat section 16 until the flat section 16 becomes generally a continuation of the curved peripheral section 14. The force on the domed section 22 further causes the rim 36 of the end wall 8 to thereafter yield at its next weakest region which is along the inner margin 28 that separates flat section 16 from the slightly inclined section 18. Indeed, the inclined section 18 bends from a slightly upwardly directed disposition to a slightly downwardly directed disposition, and in the latter it, like the flat section 16, forms a generally uninterrupted continuation of the peripheral section 14. Of course, to accommodate the deformation at the inner margin 28, the rim 36 must also yield at the corner 30 which separates the inclined and tapered sections 18 and 20. In the case of the former, the included angle at the outer margin 28 becomes greater and indeed approaches 180°, while in the latter the included angle at the corner 30 becomes smaller. Moreover, the corner 30 tends to roll inwardly toward the axis x slightly and draw the tapered section 20 downwardly, and the radius n of the bend 32 tends to increase slightly. This shortens the tapered section 20 and further reduces the angle m of its taper. Indeed, the bend 32 drops downwardly below the region 24 at which the side wall 6 joins the end wall 8. As a result of these additional deformations, which are likewise permanent in nature, the domed section 22 moves further away from the top wall 4 and increases the can volume still further. This relieves the internal pressure to a measure and in the case of a complete overfill, provides the can A with adequate head space.

Moreover, the can A when placed in an upright position on a supporting surface will rest on the corner 30 which is set inwardly from the inner margin 28 of the flat section 16. As a consequence the rim radius o is reduced still further, but the decrease is still not enough to adversely effect the stability of the can A. Indeed, the rim diameter $o_2$ remains still great enough to prevent the can A from being easily toppled in the handling equipment or elsewhere.

While the can A grows still further, the increase $t_2$ is still not enough to really be noticeable and the height of the can still remains within the limits of the equipment used for subsequent handling.

The further deformation also causes the radius of the curved peripheral section 14 to increase, and that section is in effect elongated since the sections 16 and 18 become indistinguishable extensions of it. This as previously mentioned reduces the rim diameter o slightly since the can A now rests in an upright position on the corner 30. Even though the sections 16 and 18 become continuations of the curved peripheral section 14, the dome depth $q_2$ is slightly less than the dome depth $q_1$, this being the result of a still further increase in the radius p of curvature for the central section 22.

Should the can body 2 undergo an even greater increase in pressure, the domed central section 22 will tend to flatten slightly, that is experience an increase in radius. When this occurs the bend 32 is driven outwardly beyond the corner 30, so that the central section 22, the intermediate section 20, and the continuous or aligned sections 18, 16 and 14 together tend to form an S-curve which is extremely difficult to distort any further. In other words, the can body in the region of its rim 36 will, if the pressure is increased enough, acquire a S-shaped cross-sectional configuration which is extremely resistant to further distortion.

The can body 2 will withstand substantial increases in internal pressure without any significant deformation of its domed central section 22. In other words, the domed central section 22 does not buckle outwardly, or for that matter does not otherwise deform to any significant extent. As a consequence, the central section 22 retains its concave shape and does not impair the appearance of the can or much worse project beyond the bottom of the rim 36 where it will prevent the can A from resting in a stable upright position. While permanent distortion does occur, it is confined primarily to the rim 36 and is of such a nature that it is almost imperceptible. Certainly, it does not adversely affect the appearance of the can, nor does it in any way render the can unstable. Even though the can A grows slightly and the rim diameter decreases slightly, these changes do not cause difficulties in handling equipment or with packaging. Nevertheless, the growth that does occur increases the volume sufficiently to accommodate expansion of the liquid under an increase in temperature such as may occur during the pasteurization of beer. Also in the case of a complete overfill of the type which would leave the can with no head space, the deformation of the rim 36 provides the necessary head space.

Since the end wall 8 will withstand greater pressures without buckling into an unstable configuration, the end wall 6 may be thinner than the end walls of conventional can bodies. As a consequence the can bodies may be manufactured from thinner sheet metal stock. Under present practices, the improved end wall 8 permits the can body 2 to be manufactured from aluminum sheet having a thickness of 0.0130 inches instead of 0.0134 inches which is the thinnest aluminum sheet metal currently in use. While this difference in thickness is not great, it translates into a substantial savings in cost when large volumes of can bodies 2 are produced.

A can body suitable for holding 12 oz. (355 ml) of beer may have the following dimensions and angles:

| | | |
|---|---|---|
| radius a | 1.300 in. | |
| thickness b | .0048 in. | |
| thickness c | .0130 in. | (thickness of sheet stock) |
| radius d | .090 in. | |
| radius e | .040 in. | |
| radius f | .500 in. | |
| angle g | 41° | |
| radius h | .040 in. | |
| width i | .062 in. | |
| angle j | 15° | |
| radius k | .040 in. | |
| width l | .064 in. | |
| angle m | 2°41′ | |
| radius n | .062 in. | |
| radius o | 1.0595 in. | |
| radius p | 1.750 in. | |
| depth q | .380 in. | |
| radius r | .8914 in. | |

Some of the foregoing dimensions of course change as the rim 36 of the can body 2 undergoes deformation as a result of internal pressures. In this specific can, the first deformation along the outer margin 26 (FIG. 4) begins to occur at about 50 lbs/in$^2$ gage while the second deformation along the inner margin 28 (FIG. 5) begins to occur at about 95 lbs/in$^2$ gage. When filled with the 12 oz. of beer, the head space in the can body 2 amounts to 1.36 oz. as compared to 1.24 oz. for a conventional beer can body. The head space of the can body 2 increases about 10% to 1.50 oz. in the first deformation and increases about 17% to 1.59 oz. in the second deformation.

This invention is intended to cover all changes and modifications of the example of the invention herein chosen for purposes of the disclosure which do not constitute departures from the spirit and scope of the invention.

What is claimed is:

1. A drawn and ironed can body comprising: a cylindrical side wall and an end wall formed integral with the side wall at one end of the side wall, the end wall having an annular rim joined to the side wall and a dome-shaped central section closing space encircled by the rim with the concave surface of the central section being at the exterior of the can, the rim including a curved peripheral section which is joined to the side wall and extends inwardly therefrom with its convex surface being presented outwardly, an annular base section that is joined to the curved peripheral section along the outer margin of the base section and forms the lowerst part of the can body, a first annular connecting section joined to the base section along the inner margin of the base section and being inclined slightly upwardly with respect to the base section, a second connecting section joined to the first connecting section at a corner and also being joined to the domed central section, the second connecting section also being located at an angle with respect to the base section, the rim when the pressure within the can body increases, being adapted to yield initially along the outer margin of the base section and then along the inner margin of the base section such that in both instances the central section moves away from the opposite end of the can body and increases the volume of the can body, the rim also being adapted to yield at the corner between the first and second connecting sections when it yields along the inner margin of the base section.

2. A can body according to claim 1 wherein the rim forms a groove around the central section with the groove opening into the interior of the can body.

3. A can body according to claim 1 wherein the base section becomes generally an uninterrupted continuation of the curved peripheral section before the rim yields along the inner margin of the base section.

4. A can body according to claim 1 wherein the base section becomes generally an uninterrupted extension of the curved peripheral section before the rim will yield significantly along the inner margin and corner, and the first section is inclined downwardly as a generally uninterrupted extension of the curved peripheral section and the base section after the rim has yielded to its fullest practical extent; and wherein the corner between the first connecting section and the second connecting section forms the lowest part of the can body when the rim has yielded to its fullest extent.

5. A can body according to claim 1 wherein the base section is flat and lies in a plane that is perpendicular to the cylindrical side wall.

6. A metal can body that is capable of undergoing a controlled deformation when subjected to elevated internal pressures, said can body comprising: a side wall and an end wall connected to the side wall and closing one end of the can body, the end wall having an annular peripheral section that curves downwardly from the side wall and inwardly toward the center axis of the side wall, an annular base section that merges into the peripheral section and forms the lowest part of the can body, an annular inclined section that merges into the base section and is inclined upwardly with respect to the base portion, an annular connecting section that merges into the inclined section and extends upwardly therefrom at an angle to the base section that is substantially greater than the angle between the base and inclined sections, and a domed central section that merges into the connecting section, with the concave surface of the central section being on the outwardly presented surface of the can body, the end wall, when the can body is subjected to elevated internal pressures, being adapted to yield along the base section such that the domed central section, while retaining substantially its original shape, is shifted axially away from the opposite end of the can body, whereby the volume of the can body increases.

7. A can body according to claim 6 wherein the base section is flat and lies in a plane that is perpendicular to the axis of the cylindrical side wall, and wherein the base section has outer and inner margins, it being merged into the peripheral section at its outer margin and into the inclined section along its inner margin.

8. A can body according to claim 7 wherein the end wall when subjected to elevated internal pressures will yield along the outer margin of the base section before it will yield along the inner margin of the base section.

9. A can body according to claim 8 wherein the end wall will yield along the inner margin only after the base section has yielded along its outer margin to the extent that base section is inclined downwardly generally as a continuation of the curved peripheral section.

10. A can body according to claim 9 wherein the base section will yield along its inner margin to the extent that the inclined section extends downwardly generally as an inwardly and downwardly directed extension of the peripheral section and the base section.

11. A metal can body that is capable of undergoing a controlled deformation when subjected to elevated internal pressures, said can body comprising: a cylindrical side wall and an end wall connected to the side wall and closing one end of the can body, the end wall including an annular peripheral section that extends downwardly from the side wall and inwardly toward the center axis of the can body, a base section that merges into the peripheral section and extends inwardly therefrom toward the axis of the can body, the base section forming the lowest part of the can body, an inclined section that merges into the base section and is directed upwardly therefrom, an intermediate section that merges into the inclined section and extends generally upwardly therefrom, and a domed central section that merges into the intermediate section at the upper end of the intermediate section and closes the area encircled by the intermediate section, the concave surface of the central section being presented downwardly, the end wall when the can body is subjected to elevated internal pressures being adapted to permanently yield initially along the base section such that inclination of the base section changes to the extent that the base section forms a downwardly and inwardly directed continuation of the peripheral section, whereby the inclined section, the intermediate section and the domed central section are all shifted downwardly to increase the volume of the can body.

12. The can body according to claim 11 wherein the end wall, once it has yielded such that the base section forms a downwardly and inwardly directed continuation of the peripheral section, will, if the internal pressure is of sufficient magnitude, thereafter permanently yield, also along the base section, such that the inclined section is directed somewhat downwardly from the base section, instead of upwardly, and forms a downwardly and inwardly directed continuation of the peripheral section and the base section, whereby the intermediate section and the domed central section are shifted still further downwardly to further increase the volume of the can body.

13. The can body according to claim 12 wherein the base section is joined to the peripheral section along an outer margin and to the inclined section along an inner margin, and wherein the end wall initially yields along the outer margin and thereafter yields along the inner margin when subjected to elevated internal pressures.

14. The can body according to claim 13 after it has yielded along the outer margin of the base section so that the base section forms a downwardly and inwardly directed continuation of the peripheral section.

15. The can body according to claim 13 after it has yielded along the inner margin of the base section so that the inclined section forms a downwardly and inwardly directed continuation of the base section and peripheral section.

16. The can body according to claim 13 wherein the inclined section and the intermediate section are joined together at a corner, and the corner forms generally the lowest part of the can body after the end wall has yielded along the outer margin and thereafter along the inner margin of the base section.

17. The can body according to claim 16 wherein the domed-shaped central section is joined to the tapered section at a bend, the bend before the end wall yields along the outer margin of the base section being located at least as high in the can body as the region where the peripheral section and the cylindrical side wall merge, the bend after the end wall has yielded along the inner margin of the base wall being located below the region where the peripheral section and the cylindrical side wall merge.

18. The can body according to claim 11 wherein the base section before the end wall yields along it lies generally in a plane that is perpendicular to the axis of the can body.

19. The can body according to claim 11 wherein the peripheral section is curved in a plane within which the axis of the side wall lies, with the resulting convex surface being presented outwardly on the exterior of the can body.

20. The can body according to claim 11 wherein the domed-shaped central section is joined to the intermediate section at a bend, and the bend before the end wall yields is located at least as high in the can body as the region where the peripheral section and the cylindrical side wall merge.

21. A metal can body that is capable of undergoing a controlled deformation when subjected to elevated internal pressures, said can body comprising: a cylindrical side wall and an end wall connected to the side wall and closing one end of the can body, the end wall including an annular peripheral section that extends downwardly from the side wall and inwardly toward the center axis of the can body, a circular, dome-shaped center section located inwardly from the peripheral section with its concave surface being presented downwardly, and at least two additional sections located between the peripheral section and the center section and serving to connect the peripheral section and the center section, one of the additional sections being connected to the peripheral section and extending generally inwardly therefrom, said one additional section being substantially the frustum of a shallow cone that is inclined upwardly away from the peripheral section, the width of said one additional section being substantially less than the radius of the dome-shaped center section, another of the additional sections being oriented in a generally upright disposition and being connected to the center section at a band in the metal of the end wall, with the bend being located substantially above said one additional section and the domed-shaped center section being located entirely above the two additional sections, said other additional section extending generally downwardly from the center section and being disposed at a steep angle with respect to said one additional section, the can body when the end wall is subjected to elevated internal pressures being adapted to permanently yield along the periphery of said one additional section such that the inclination of the one additional section changes and the one additional section becomes a downwardly and inwardly directed continuation of the peripheral section, whereby the other additional section and the dome-shaped center section shift downwardly to increase the volume of the can body.

22. A metal can body that is capable of undergoing a controlled deformation when subjected to elevated internal pressures, said can body comprising: a cylindrical side wall and an end wall connected to the side wall and closing one end of the can body, the end wall including an annular peripheral section that extends downwardly from the side wall and inwardly toward the center axis of the can body, a circular, dome-shaped center or section located inwardly from the peripheral section with its concave surface being presented downwardly, and at least two additional sections located between the peripheral section and the center section and serving to connect the peripheral section and the center section, the two additional sections being connected to each other at a corner where they are disposed at a substantial angle with respect to each other, one of the additional sections being substantially flat and directed generally inwardly away from the peripheral section and further being inclined slightly upwardly, the width of said one additional section being substantially less than the radius of the dome-shaped center section, the other of the additional sections being oriented in a generally upright disposition and being connected to the center section at a bend in the metal of the end wall, with the bend being located substantially above said one additional section and the dome-shaped center section being located entirely above the two additional sections, said other additional section extending generally downwardly from the center section to the corner where it joins said one additional section, the can body when the end wall is subjected to elevated internal pressures of sufficient magnitude being adapted to permanently yield along the periphery of said one additional section such that the one additional section changes from a slightly upward inclination to a slightly downward inclination, whereby the other additional section and the dome-shaped center section shift downwardly to increase the volume of the can body.

* * * * *

UNITED STATES PATENT AND TRADEMARK OFFICE

CERTIFICATE OF CORRECTION

PATENT NO. : 4,412,627

DATED : November 1, 1983

INVENTOR(S) : Timothy J. Houghton et al

It is certified that error appears in the above-identified patent and that said Letters Patent is hereby corrected as shown below:

Column 8, Claim 1, line 22, "lowerst" should be "lowest".

Column 9, Claim 6, line 3, "base portion" should be "base section".

Column 11, Claim 21, line 10, "band" should be "bend".

Column 12, Claim 22, line 2, "center or section" should be "center section".

Signed and Sealed this

*Twenty-fourth* Day of *January 1984*

[SEAL]

*Attest:*

GERALD J. MOSSINGHOFF

*Attesting Officer*

*Commissioner of Patents and Trademarks*